US005172638A

United States Patent [19]

Mathison et al.

[11] Patent Number: 5,172,638

[45] Date of Patent: Dec. 22, 1992

[54] DUST SUPPRESSION SYSTEM FOR RAILROAD TRACK BALLAST CLEANING APPARATUS

[75] Inventors: Dennis R. Mathison, Hamel; Charles R. Mackey, Buffalo, both of Minn.

[73] Assignee: Loram Maintenance of Way, Inc., Hamel, Minn.

[21] Appl. No.: 823,585

[22] Filed: Jan. 16, 1992

Related U.S. Application Data

[63] Continuation of Ser. No. 507,717, Apr. 10, 1990, abandoned.

[51] Int. Cl.[5] ..... E01B 27/02

[52] U.S. Cl. ..... 104/7.3; 104/2; 37/105

[58] Field of Search ..... 104/7.3, 2, 279; 169/64; 239/662; 37/104, 105, 106, 107; 405/258, 271; 15/340.1, 340.3, 340.4; 299/12

[56] References Cited

U.S. PATENT DOCUMENTS

| | | | |
|---|---|---|---|
| 2,196,880 | 1/1938 | Van Voorhis et al. . | |
| 2,693,950 | 11/1954 | Calder | 299/12 |
| 2,734,730 | 8/1950 | Talboys . | |
| 2,775,438 | 12/1956 | Bach et al. . | |
| 2,900,745 | 8/1953 | Walters . | |
| 3,080,665 | 3/1963 | Keller et al. . | |
| 3,850,251 | 11/1974 | Plasser et al. . | |
| 3,900,392 | 8/1975 | Speno et al. . | |
| 4,157,204 | 6/1979 | Kissell et al. | 299/12 |
| 4,203,493 | 5/1980 | Miller . | |
| 4,227,324 | 10/1980 | Theurer . | |
| 4,315,658 | 2/1982 | French et al. | 299/12 |
| 4,358,160 | 11/1982 | Kissell et al. | 299/12 |
| 4,380,353 | 4/1983 | Campbell et al. | 299/12 |
| 4,648,659 | 3/1987 | Masovich et al. | 299/12 |
| 4,705,115 | 11/1987 | Whitaker | 104/7.3 |

*Primary Examiner*—Robert J. Oberleitner
*Assistant Examiner*—Mark T. Le
*Attorney, Agent, or Firm*—Patterson & Keough

[57] ABSTRACT

A dust suppression system is particularly designed for the control of dust generated by a self-propelled, on-site, shoulder ballast cleaning machine. The shoulder ballast cleaning machine scoops up the stone ballast of a railroad track bed, separates the ballast from dirt and debris, and replaces the ballast along the shoulder of the track bed. The dust suppression system includes a main pressure line extending along the length of the shoulder ballast cleaning machine, and a plurality of branch lines connecting the main line to spray assemblies positioned on the shoulder ballast cleaning machine at areas of primary dust generation. The various assemblies provide a liquid spray pattern to moisten the air borne dust and debris, neutralizing the static electricity charge of the dust and debris, and/or increasing the particulate weight, and causing the dust and debris to rapidly settle. Each branch distribution line includes a filter, a globe valve for adjusting the flow of water to each individual spray assembly, and a remotely actuated solenoid for selectively connecting and disconnecting the branch line to the main line.

10 Claims, 20 Drawing Sheets

Fig. 1

| | | | | |
|---|---|---|---|---|
| Fig. 1a | Fig. 1b | Fig. 1c | Fig. 1d | Fig. 1e | Fig. 1f |

Fig. 2

| | | | | | |
|---|---|---|---|---|---|
| Fig. 2a | Fig. 2b | Fig. 2c | Fig. 2d | Fig. 2e | Fig. 2f |

DUST SUPPRESSION SYSTEM FOR RAILROAD TRACK BALLAST CLEANING APPARATUS

This application is a continuation of patent application Ser. No. 67/507,717, filed on Apr. 10, 1990, now abandoned.

TECHNICAL FIELD

This invention relates to machines for on-site cleaning of railroad track bed ballast material. In particular, it relates to a dust suppression system for controlling the dust generated in the ballast cleaning process.

BACKGROUND ART

Railroad track rails and cross ties are conventionally supported on beds of stone ballast. The stone ballast provides a firm foundation for the cross ties and rails, and the spaces between the stone ballast allows for proper drainage of rain water away from the railroad track. Over time, the spaces between the individual stones of the stone ballast can become fouled with mud and debris. The fouling of the ballast interferes with proper drainage, thereby contributing to premature deterioration of the wooden cross ties, and detracting from the firmness of the track bed.

It has become commonplace for railroad companies to periodically remove and clean the stone ballast from the shoulders of railroad track beds. Such periodic cleaning of the ballast from the track shoulders allows for adequate drainage of water from the track bed, even when the ballast from the center of the track bed is not removed and cleaned. The stone ballast is typically removed from the track bed shoulder, carried to a vibrating screen separator where the stone ballast is separated from dirt and debris, and the cleaned stone ballast is replaced along the track bed shoulder. The residual dirt and debris is deposited to one side or the other of the track bed, or can be collected in a separate car for removal from the cleaning site.

The process of cleaning railroad track shoulder ballast necessarily produces large amounts of airborne dust and debris. The generated dust and debris can seriously degrade the visibility in the immediate vicinity of the shoulder ballast cleaner, making it difficult or impossible for the operator to view and control the cleaning operation. Moreover, the resulting degradation in air opacity and overall air quality can reach unacceptable levels, and ballast cleaning operations have come under the scrutiny of several governmental agencies concerned with the maintenance of air quality standards. Since there has heretofore been no suitable apparatus for controlling the dust and debris generated in rail shoulder ballast cleaning operations, necessary railroad track maintenance has, on occasion, been delayed and even cancelled.

A dust suppression system for a railroad shoulder ballast cleaning machine that could suppress the airborne dust and debris generated by the shoulder ballast cleaning operation, would fill a long felt need in the railroad maintenance industry.

SUMMARY OF THE INVENTION

The dust suppression system in accordance with the present invention is particularly designed for the control of dust generated by a self-propelled, on-site, shoulder ballast cleaning machine. The dust suppression system hereof includes a plurality of spray assemblies positioned on the shoulder ballast cleaning machine at areas of primary dust generation. Each spray assembly is particularly designed and positioned to provide an optimum liquid spray pattern, with maximum wind isolation, at its particular area of dust generation. The sprayed liquid moistens the air borne dust and debris, neutralizing its static electricity charge, increasing the particulate weight and causing the dust and debris to rapidly settle. Individual branch fluid distribution lines connect the various spray assemblies to a main distribution line for the supply of water, or some other surfactant, to the spray assembly nozzles. Each branch distribution line includes a filter, a globe valve for adjusting the flow of water to each individual spray assembly, and a remotely actuated solenoid for selectively connecting and disconnecting the branch line to the main line. The pressure pump draws water from a reservoir tank car, and pressurizes the main and branch distribution lines.

BRIEF DESCRIPTION OF THE DRAWINGS

FIG. 1 is the combination of FIGS. 1*a*–1*f*;

FIG. 2 is the combination of FIGS. 2*a*–2*f*;

DETAILED DESCRIPTION OF THE DRAWINGS

Figure 1A:
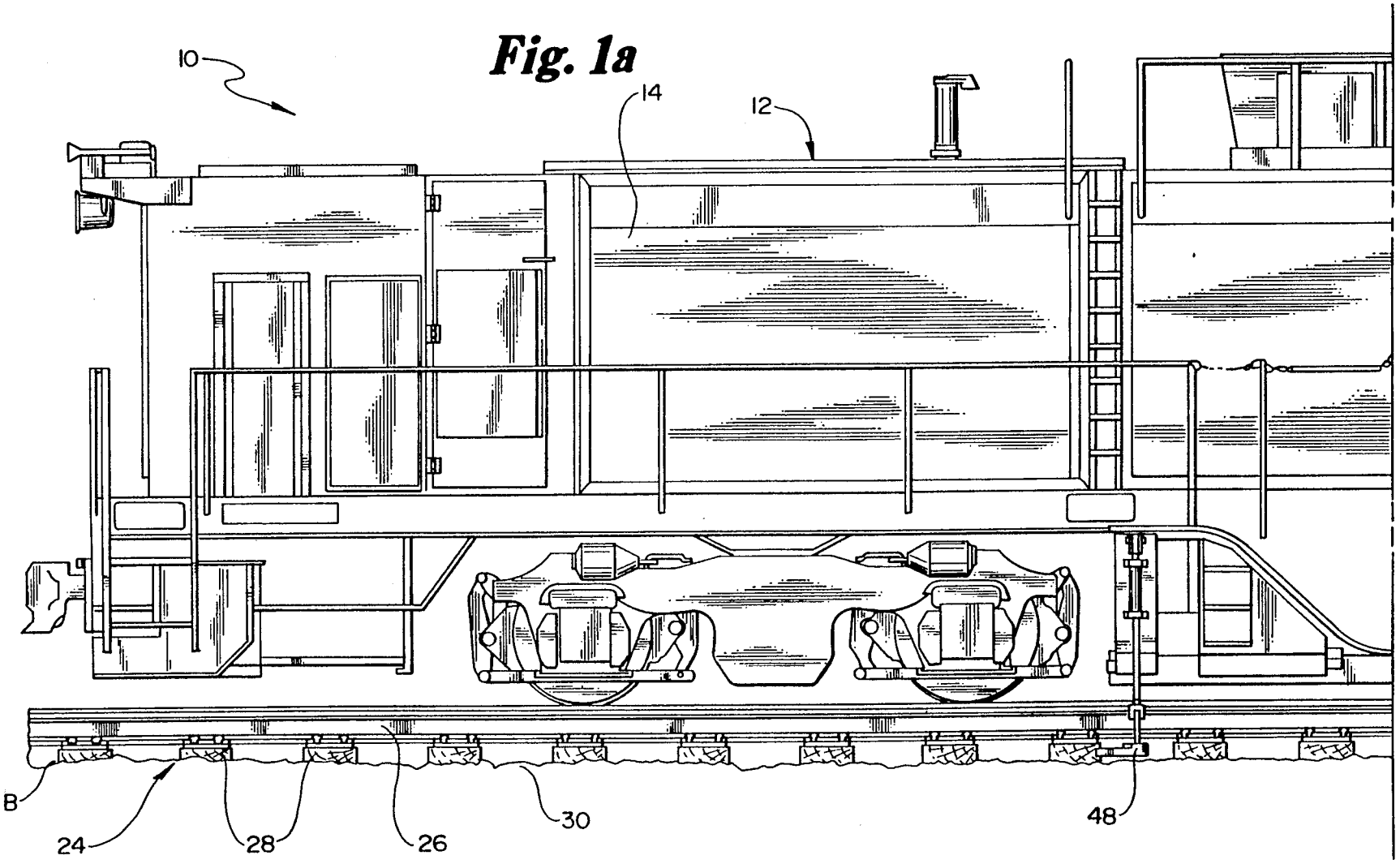
FIGS. 1*a* through 1*f* are a multiple sheet, left-side elevational view of a shoulder ballast cleaning machine having a dust suppression system in accordance with the present invention mounted thereon.

Referring to the drawings, shoulder ballast cleaning machine 10 includes power car 12 having engine compartment 14 and forward operator cab 16, and auxiliary car 18 having rear operator cab 20. Tank car 22 is detachably coupled to the rear of the auxiliary car 18. The shoulder ballast cleaning machine 10 is supported by railroad track 24 having rails 26 and cross ties 28. The rails 26 and cross ties 28 are supported on a track bed of 30 made up of stone ballast B.

The shoulder ballast cleaning machine 10 further includes right and left digger wheels 32, 34, cross conveyors 36, 38, lift conveyor 40, screen separator 42, waste conveyor 44, and swing conveyor 46. Front and rear scarifiers 48, 50 are positioned on each side of the shoulder ballast cleaning machine 10 for loosening the shoulder ballast making up track bed 30.

Figure 1B:
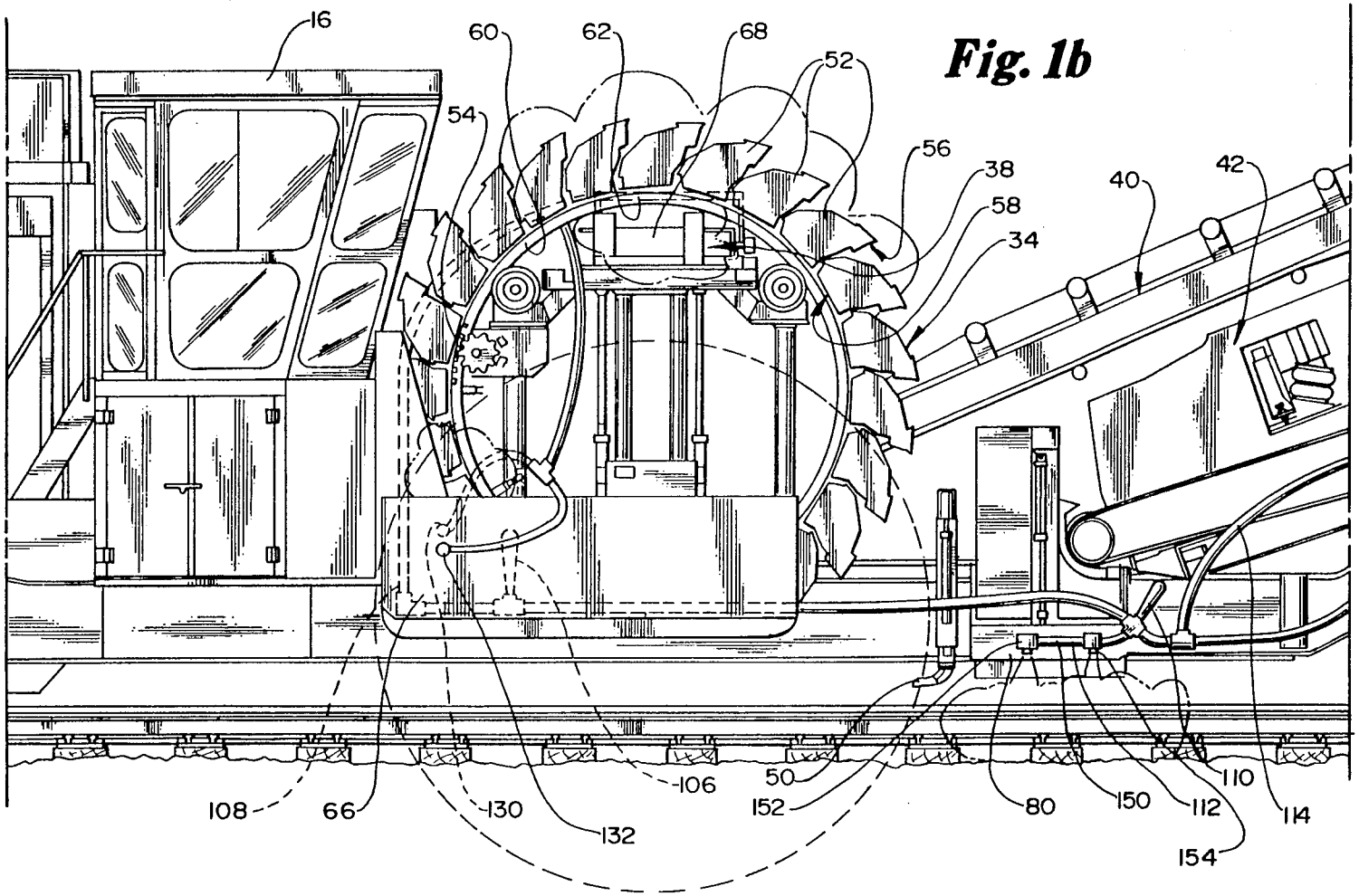
Figure 1C:
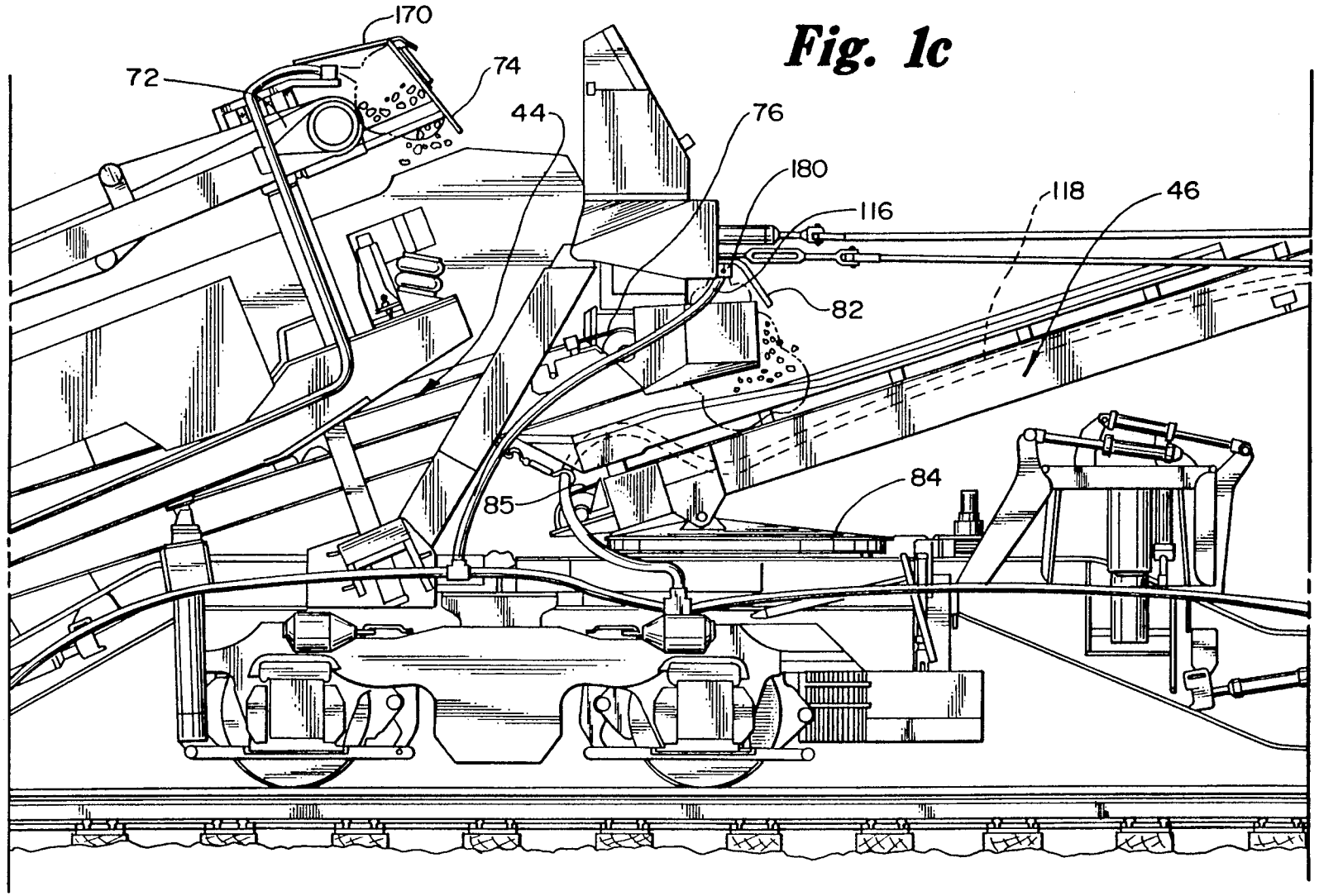

Digger wheels 32, 34 each include a plurality of digger buckets 52, mounted on individual rotating support wheels 54. The digger buckets 52 each include an open scoop face 56 and open bottom 58. The open bottoms 58 slide along stationary ring 60. The ring 60 includes opening 62 at its upper most portion. Referring to FIG. 1*b*, the digger wheel 52 is rotated in a clockwise direction when shoulder ballast cleaning machine 10 is in operation, and the stationary ring 60 supports scooped ballast within the digger buckets 52 until the digger buckets 52 reach the opening 62 in the uppermost portion of the stationary ring 60. Shrouds 64, 66 cover the lower front and lower sides of the digger wheels 32, 34 respectively. The digger wheels 32, 34 are shiftable from the stowed position, as depicted in FIG. 1*b*, to a lowered, operating position, as depicted by phantom lines in FIG. 1*b*.

Cross conveyors 36, 38 include endless webs 68, 70 extending from the opening 62 in their respective stationary ring 60 to the approximate center line of the machine 10. The cross conveyors 36, 38 are separated by a gap 69 that allows the material carried by the endless web 68, 70 to fall in between the two conveyors 36, 38. Cross conveyor batterboard 71 directs the material carried by the cross conveyors 36, 38 into the gap 69.

Lift conveyor 40 includes endless web 72 that extends from immediately below the cross conveyors 36, 38, upwardly and rearwardly, to a point just above the screen separator 42. Lift conveyor batterboard 74 directs the discharge of the lift conveyor 72 downwardly onto the screen separator 42.

Screen separator 42 includes an internal screen (not shown) that extends along the length of the screen separator 42. Waste conveyor 44 includes endless web 76 that extends along the bottom of the screen separator 42 and rearwardly to a point above the swing conveyor 46. Right and left ballast hoppers 78, 80 are located just forward of and below the screen separator 42. Waste conveyor batterboard 82 is located at the upper, discharge portion of waste conveyor 44 for directing the discharge for the waste conveyor downwardly onto the swing conveyor 46.

Swing conveyor 46 is pivotally mounted on trunnion 84. The swing conveyor 46 includes endless web 85 extending from a point just below the discharge of the waste conveyor 44 rearwardly to the swing conveyor discharge end 86. As is depicted in phantom lines in FIG. 2*c* and 2*d*, the swing conveyor 46 may be positioned either to the right or the left of the shoulder ballast cleaning machine 10.

Figure 9:
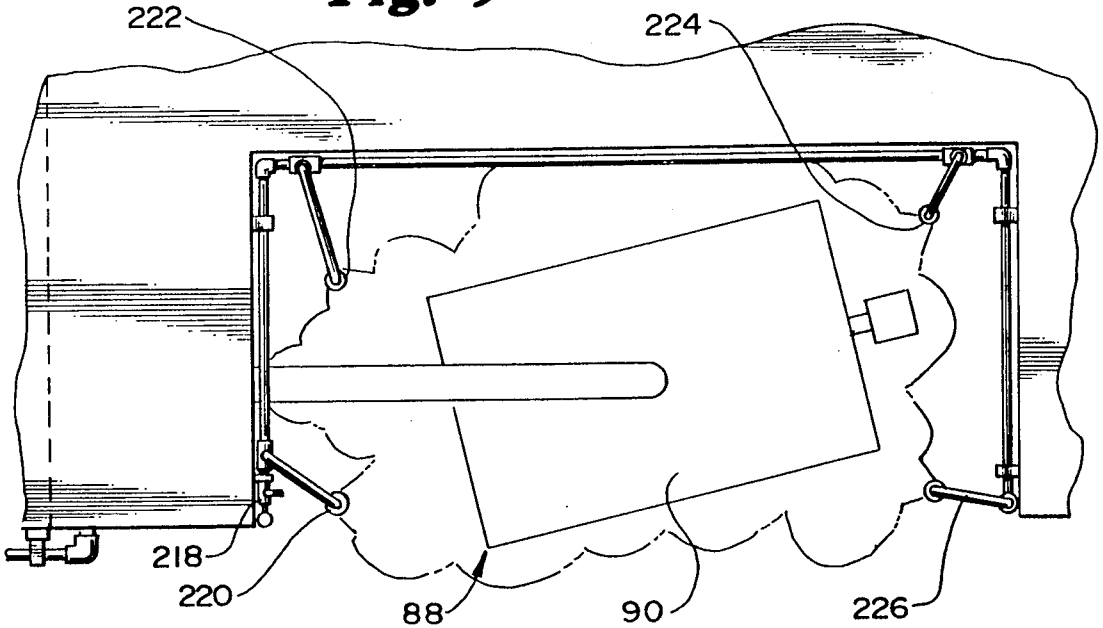
FIG. 9 is a top plan, pictorial view of the broom assembly liquid distribution branch line of the dust suppression system.

Right and left broom assemblies 87, 88 are mounted at the rear of the auxiliary car 18. The broom assemblies 87, 88 each include a rotatable, cylindrical broom 90 shiftable between a raised, stowed position, and a lowered, operating position. As can be seen in FIG. 9, brooms 90 can be canted outwardly.

The shoulder ballast cleaning machine 10 is operated in a forward direction, from right to left as depicted in FIGS. 1 and 2, at a speed of about two miles per hour. The digger wheels 32, 34 are lowered into their digging position, as depicted in phantom lines in FIG. 1*b*, and rotated in a clockwise direction (from the perspective of FIG. 1*b*). Stone ballast and debris along the shoulder of the track bed 30 are scooped into the digger buckets 52, and lifted upwardly, with the stationary ring 60 holding the dirt and debris in the buckets 52. When each bucket 52 reaches the top of its respective digger wheel 32, 34, the stone ballast and debris in the bucket 52 are discharged onto the cross conveyors 36, 38 through the open bottom 58 of the bucket 52, and through the opening 62 in digger wheel stationary ring 60. The stone and debris are transferred to the center of the shoulder ballast cleaning machine 10 by cross conveyors 36, 38, and are deposited onto the lift conveyor 40 through gap 69.

The stone ballast and debris are lifted upwardly and rearwardly by lift conveyor 40, and are discharged from the uppermost end of the lift conveyor 40. Lift conveyor batterboard 74 directs the stone and debris downwardly into the screen separator 42.

The screen of the screen separator 42 includes openings large enough for dust and debris to fall through the screen, but not large enough to allow the stone ballast to fall through the screen. Vibrating machinery is attached to the screen separator 42 so that the stone ballast and debris are vigorously shaken on the screen surface. The debris falls through the screen onto the waste conveyor, and the stone ballast falls downwardly and forwardly. The clean stone ballast is discharged into the stone ballast hoppers 78, 80 located at the forward end (bottom) of the screen separator 42. The cleaned stone ballast in the hoppers 78, 80 is then deposited onto the railroad track bed 30.

The debris deposited on the waste conveyor 44 by the screen separator 42 is transported rearwardly and upwardly by the waste conveyor 44. The waste and debris discharged from the waste conveyor is directed downwardly by the waste conveyor batterboard 82 onto swing conveyor 46. The swing conveyor 46 is swung to the right or the left of the shoulder ballast cleaning machine, and the waste and debris is discharged from the swing conveyor to the side of the railroad track bed. The rails 26 and cross ties 28 are swept clear of loose stone ballast by the right and left broom assemblies 87,88.

The dust suppression system 100 in accordance with the present invention is mounted on the shoulder ballast cleaning machine 10, and provides a dust suppressing, liquid mist at the principal dust generating positions on the machine 10. The dust suppression system 100 broadly includes main fluid distribution line 102, tank car 22, pressure pump 104, a plurality of branch fluid distribution lines to be described in detail hereinafter, and dust suppression spray assemblies particularly designed and positioned for suppression of dust at the primary dust generating areas along the shoulder ballast cleaning machine 10.

The main distribution line 102 extends along the length of the shoulder ballast cleaning machine 10 from the tank car 22 forwardly to the digger wheels 32, 34. The pressure pump 104 draws water from the tank car 22 and pressurizes the main line 102 to about 70 psi, and provides a flow rate of approximately 10 gallons per minute through the system.

The fluid distribution branch lines include right and left digging wheel and cross conveyor branch lines 106, 108, right and left hopper branch lines 110, 112, lift conveyor branch line 114, waste conveyor discharge branch line 116, swing conveyor discharge branch line 118, and right and left broom assembly branch lines 120, 122.

Figure 3:
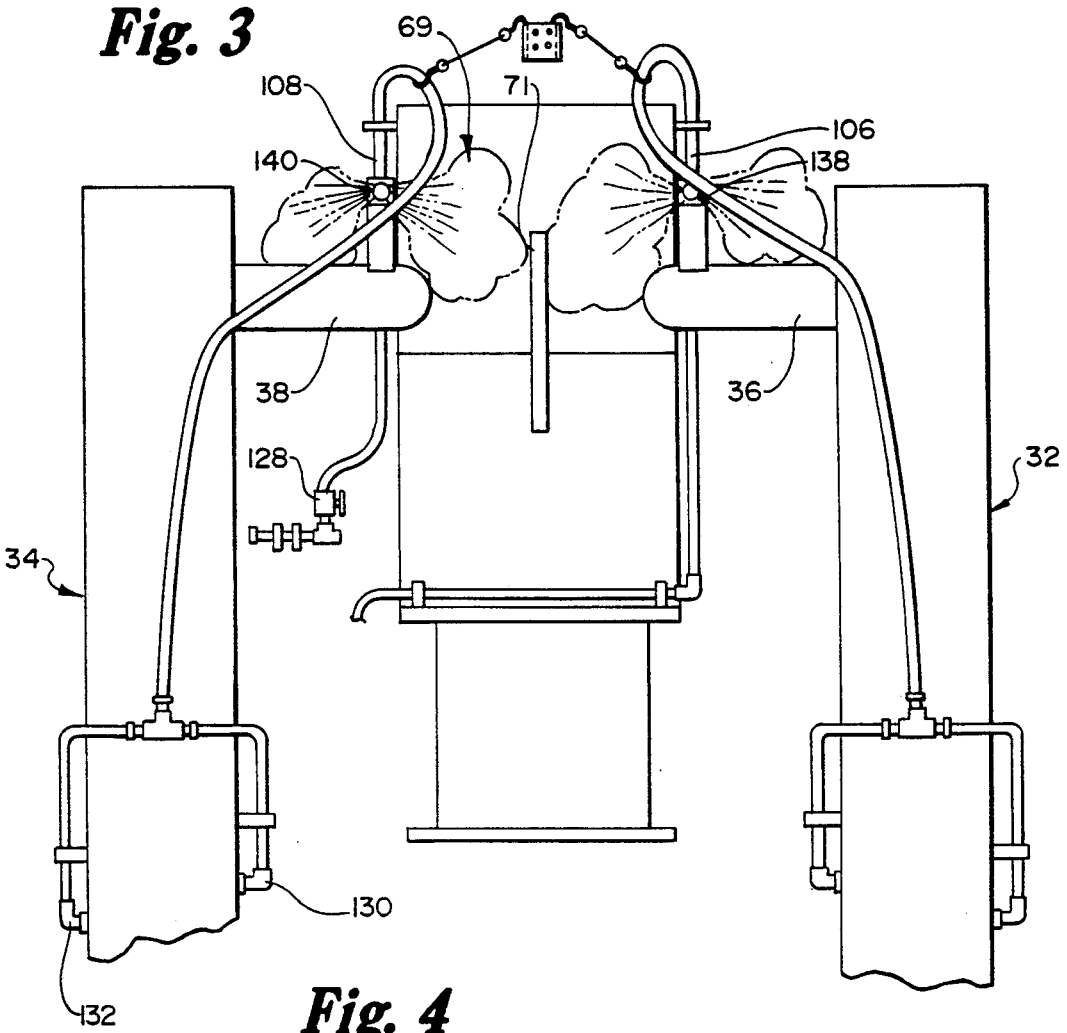
FIG. 3 is a rear elevational, pictorial view of the digger wheel and cross conveyor liquid distribution branches of the dust suppression system.
Figure 10A:
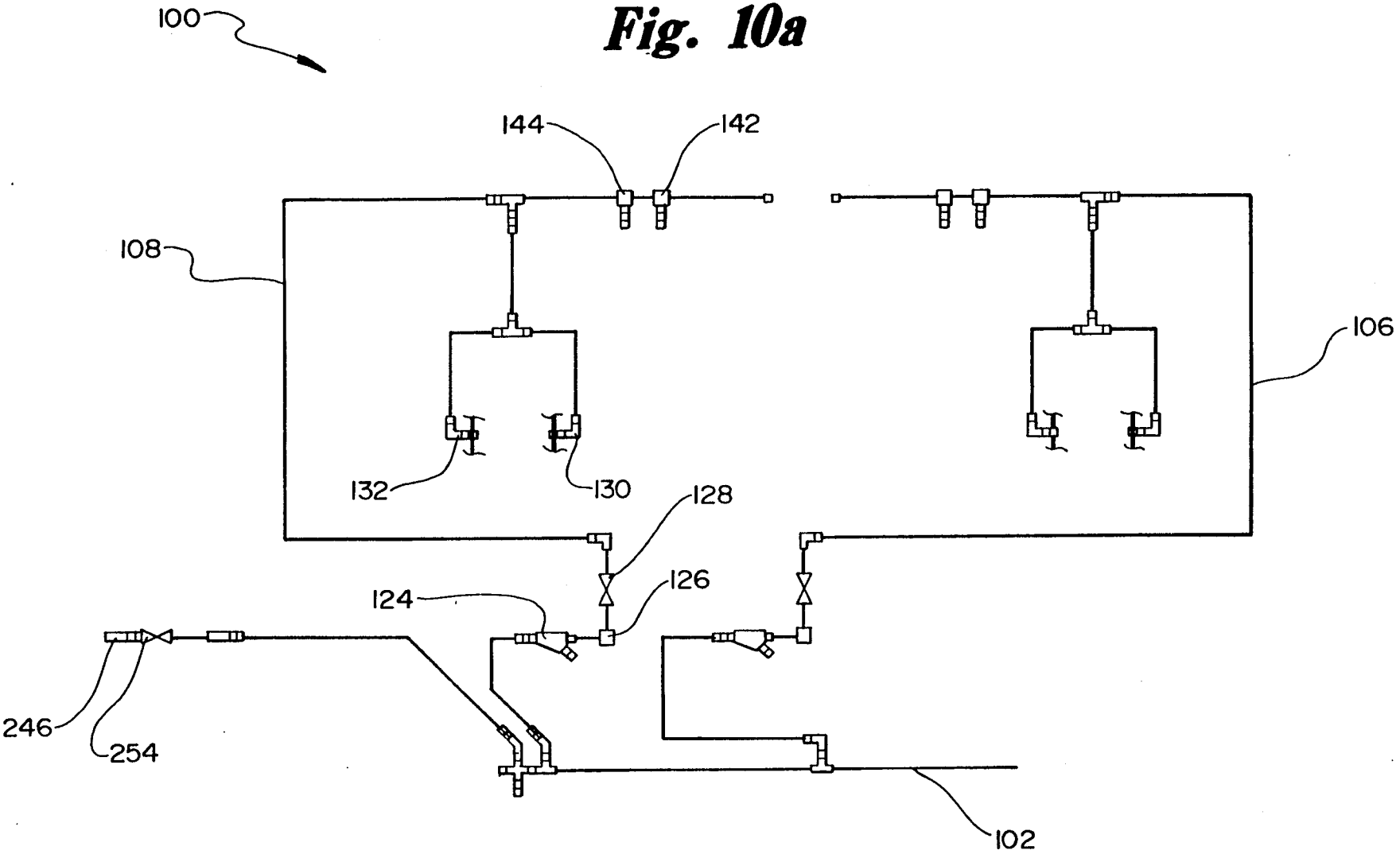
FIGS. 10*a*–10*d* are a multiple sheet schematic depiction of the dust suppression system in accordance with the present invention.

The right and left digging wheel and cross conveyor branch lines 106, 108 will be described with reference to FIGS. 3 and 10*a*. The right and left branch lines 106, 108 are identical, and only left branch line 108 will be described. Branch line 108 includes filter 124, activating solenoid 126, and adjustable globe valve 128. The activating solenoid 126 is remotely actuated by the operator in the rear operator cab 20 to selectively isolate branch line 108 from the main line 102. Globe valve 128 is hand adjustable to regulate the flow of fluid through the digging wheel and cross conveyor branch line 108. Referring to FIGS. 3 and 1*b*, a pair of opposed, digger wheel assembly nozzles 130, 132 are mounted on the field side 134 and gauge side 136 of the digger wheel shroud 66. The digger wheel spray nozzles 130, 132 are horizontally aligned, as seen in FIG. 1*b*, but vertically separated, with the gauge side nozzle above the field side nozzle. Again referring to FIG. 1*b*, it will be seen that the digger wheel spray nozzles 130, 132 are located just forwardly of the digger buckets 52 within the shroud 66. The digger wheel spray nozzles 130, 132 provide a full cone spray pattern, and the vertical offset of the nozzles provides for full spray coverage within the interior of the shroud 66 forward of the digger buckets 52.

Figure 2A:
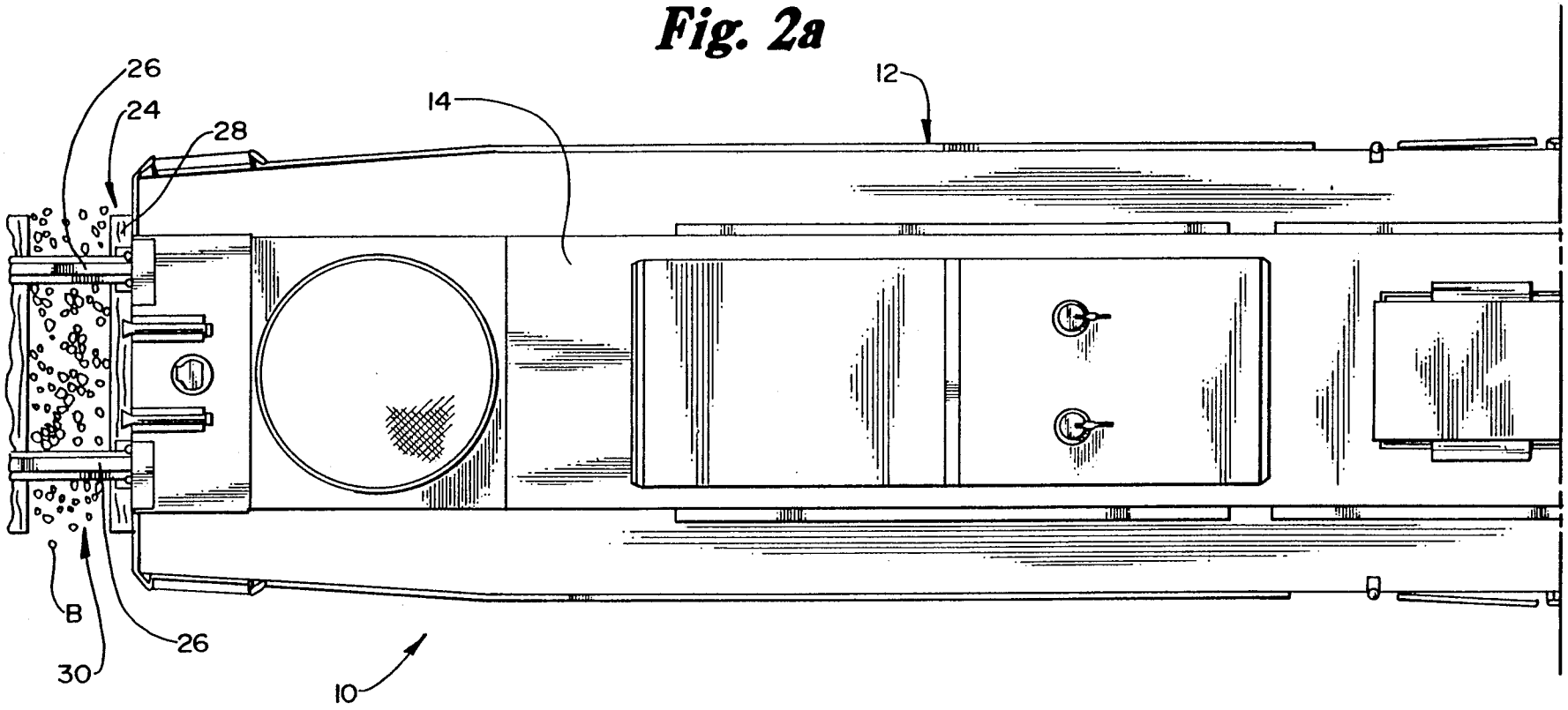
FIG. 2*a* through 2*f* are a multiple sheet, top plan view of the shoulder ballast cleaning machine depicted in FIG. 1.
Figure 2B:
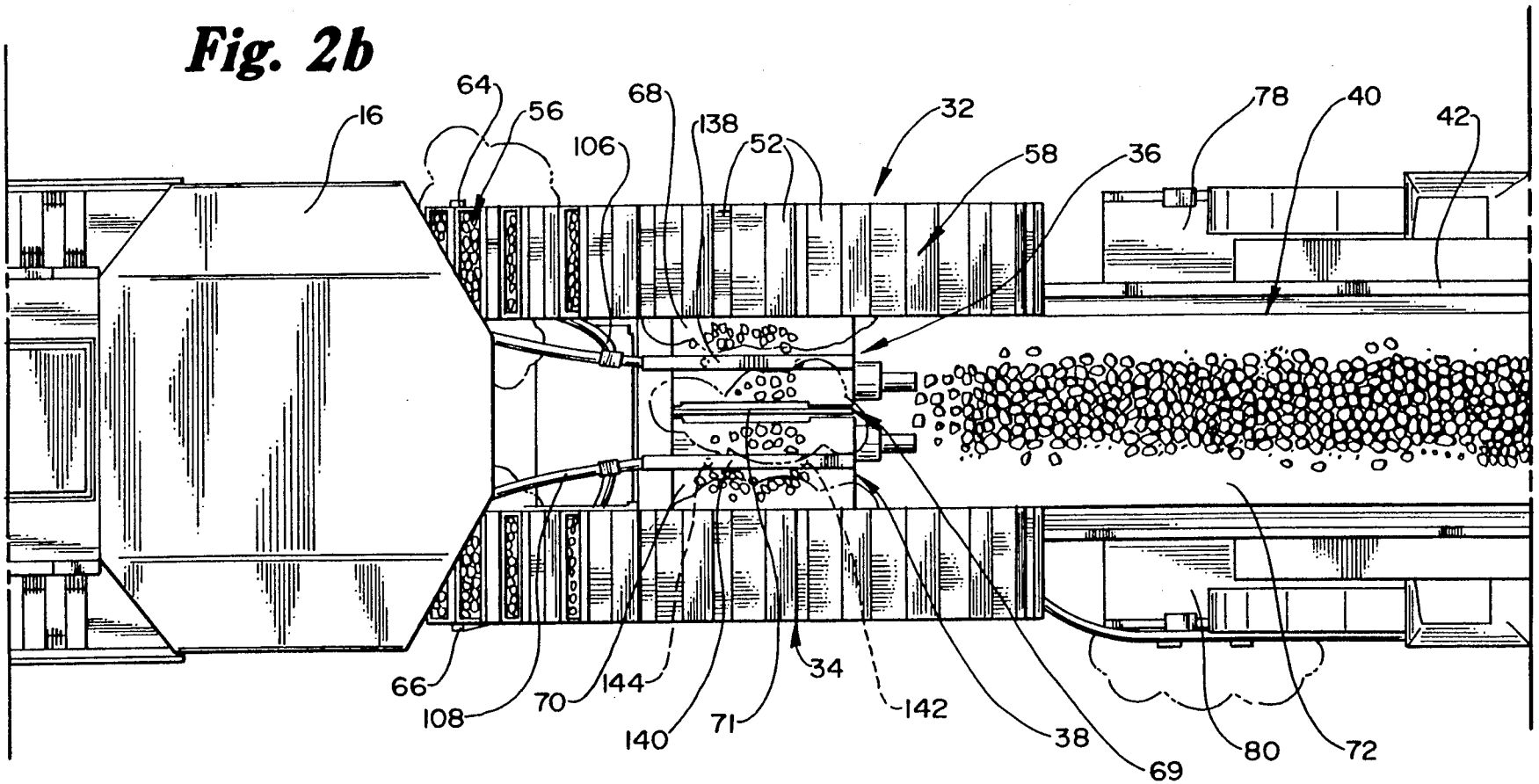
Figure 2C:
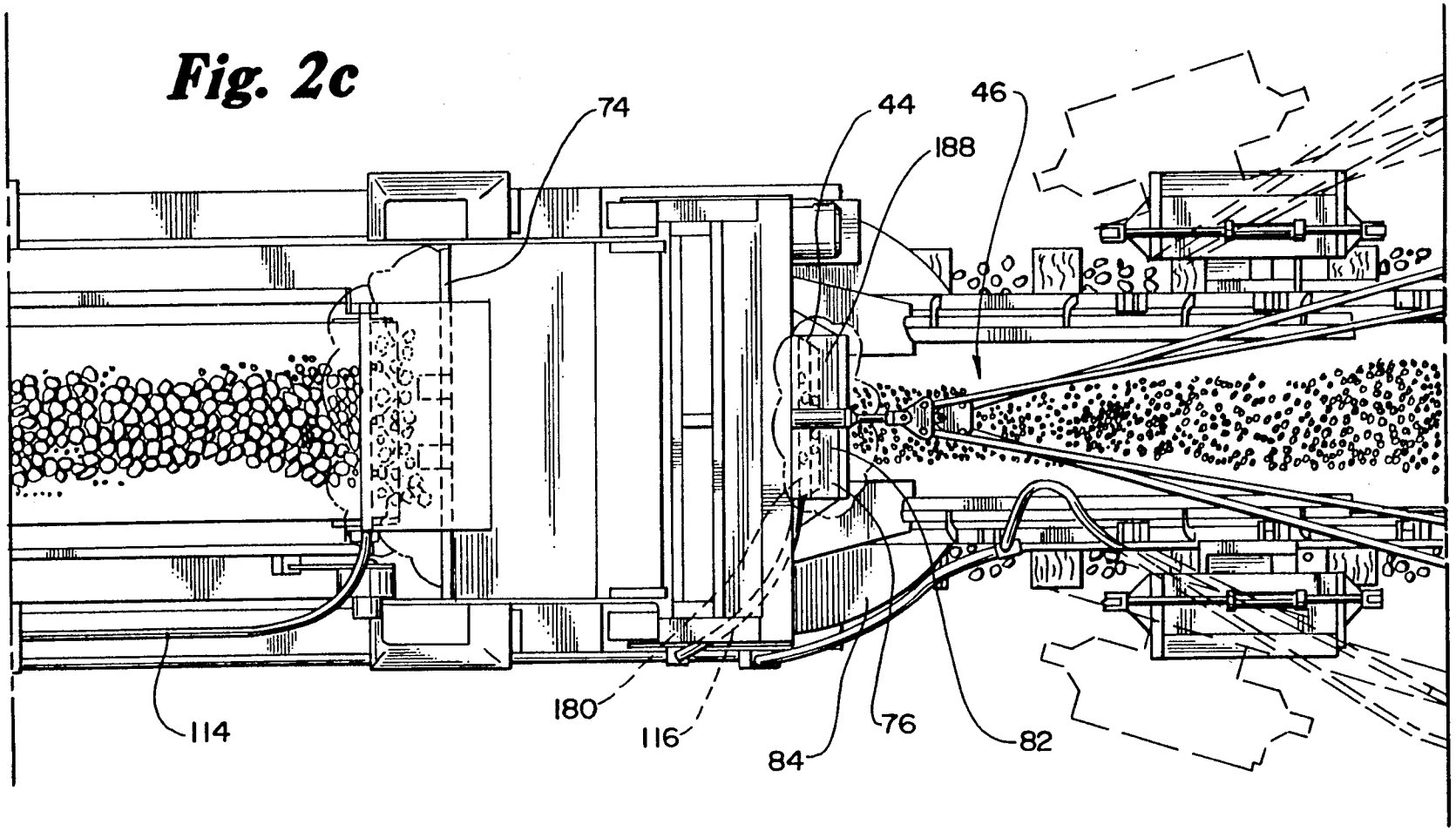

As best seen in FIG. 2*b*, the right and left digging wheel and cross conveyor branch lines 106, 108 each terminate at uppermost, right and left cross conveyor spray bars 138, 140. Each spray bar 138, 140 includes a pair of spray nozzles 142, 144. As seen in FIG. 3, the spray nozzles 142, 144 direct liquid spray onto the cross conveyors 36, 38 and against the cross conveyor batterboard 71.

Figure 4:
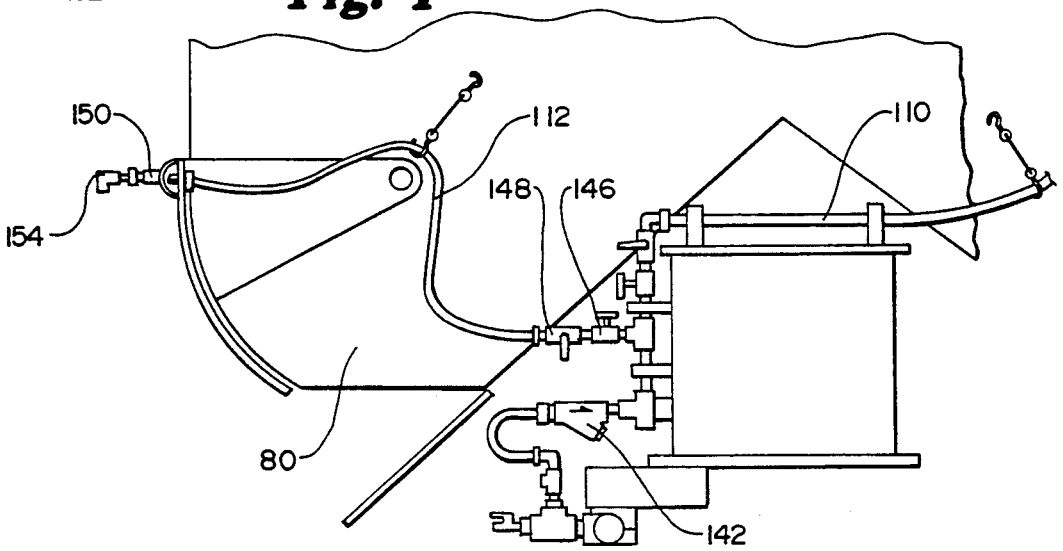
FIG. 4 is a rear elevational, pictorial view of the hopper liquid distribution branch line of the dust suppression system.
Figure 6:
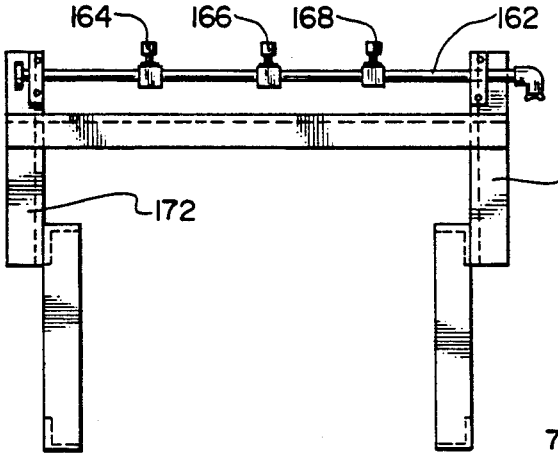
FIG. 6 is a top plan view of the spray bar depicted in FIG. 5.
Figure 5:
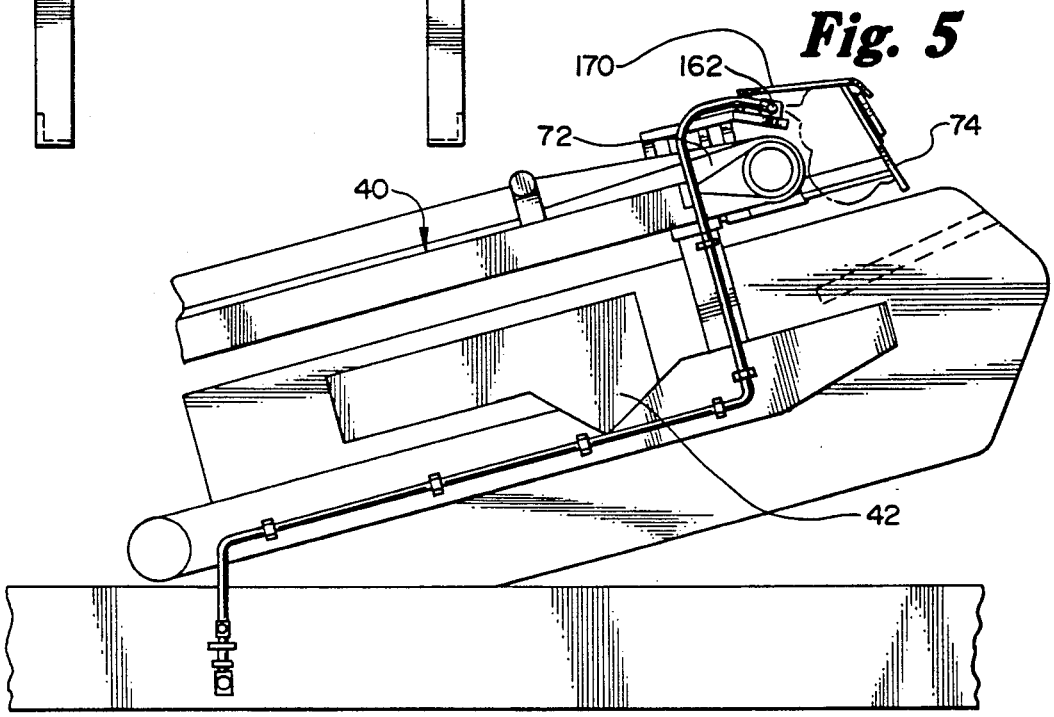
FIG. 5 is a left side elevational, pictorial view of the load conveyor liquid distribution branch line of the dust suppression system.
Figure 10B:
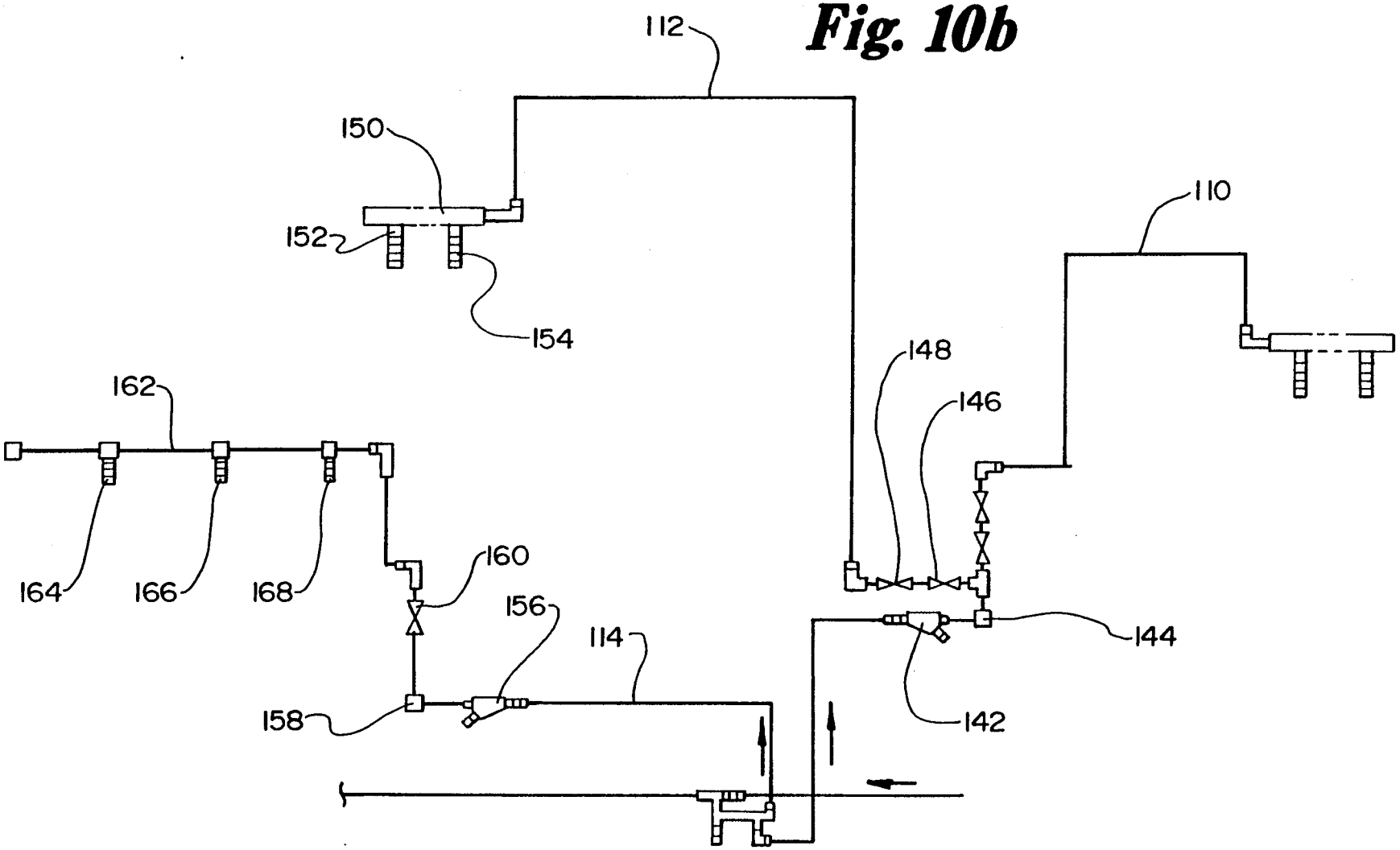

Referring to FIGS. 10*b* and 4, the right and left hopper branch lines 110, 112 are connected to the main fluid distribution line 102 through a single filter 142 and actuating solenoid 144. The right and left hopper branch lines 110, 112 are identical, and only the left branch line 112 will be described. The branch line 112 includes globe valve 146 for regulating the flow of liquid through the branch line 112 and ball valve 148 for selective isolation of the branch line 112. The branch line 112 terminates at hopper spray bar 150. The hopper spray bar 150 includes a pair of in line spray nozzles 152, 154 positioned on the field side of the ballast hopper 80.

The lift conveyor discharge branch line 114 will be described with reference to FIGS. 1*c*, 2*c*, 5, 6 and 10*b*. The lift conveyor discharge branch line 114 includes filter 156, actuating solenoid 158 and globe valve 160. The lift conveyor discharge branch line 114 terminates at spray bar 162. Spray bar 162 includes three spaced apart spray nozzles 164, 166, 168. The spray bar 162 is oriented slightly above the discharge end of the lift conveyor 114, and the spray nozzles 164, 166, 168 direct fluid spray downwardly towards the conveyor discharge area. A sheet of flashing 170 is oriented above the spray bar 162 and side flashing 170, 172 may also be advantageously positioned so as to protect the spray pattern emanating from spray nozzles 164, 166, 168 of spray bar 162 from wind dissipation.

Figure 7:
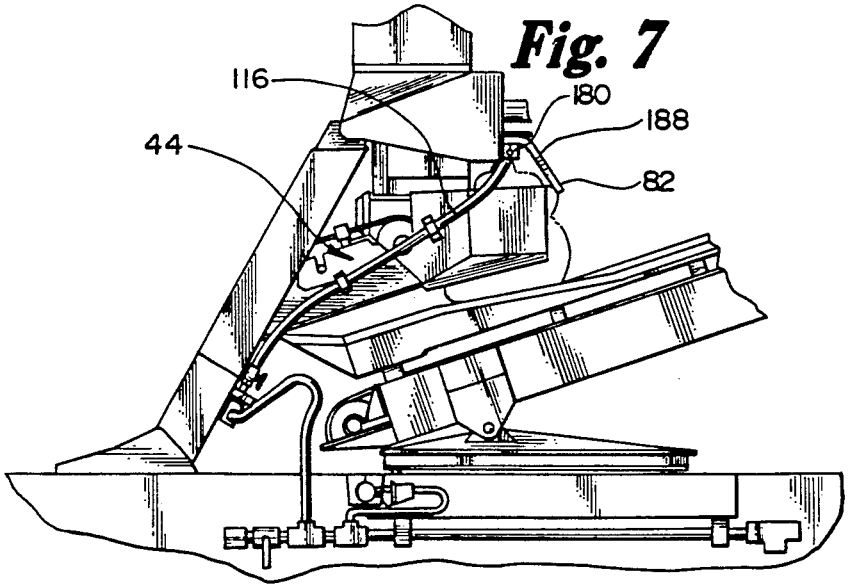
FIG. 7 is a left side elevational, pictorial view of the waste conveyor liquid distribution branch line of the dust suppression system.
Figure 8:
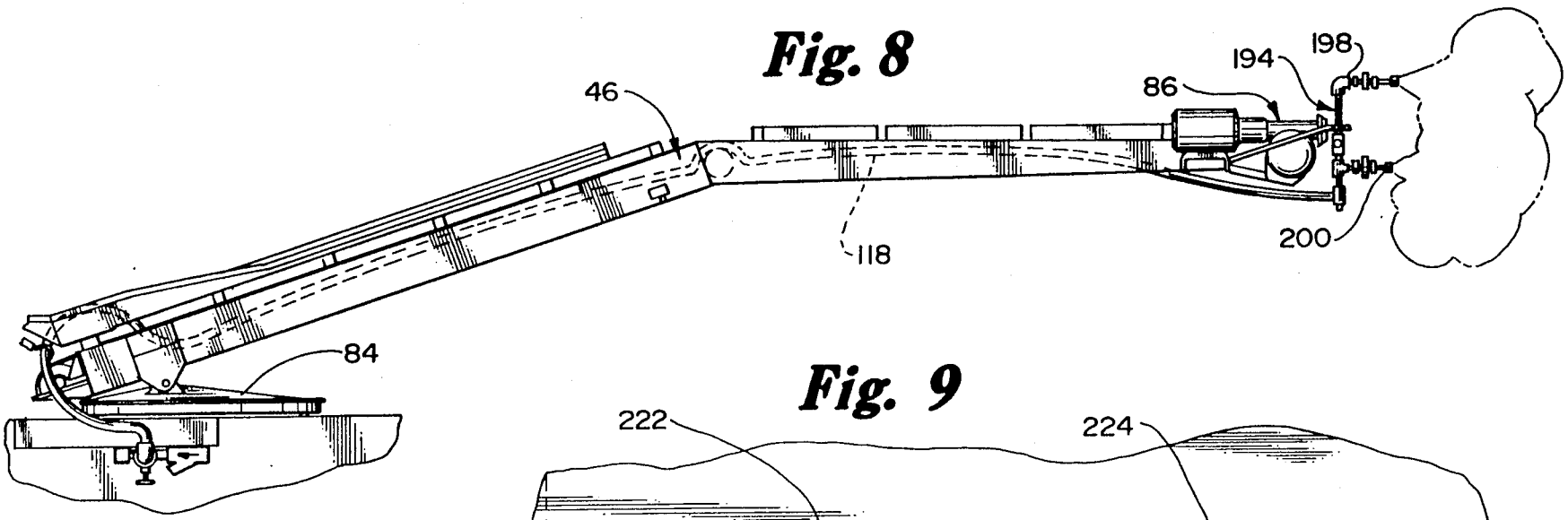
FIG. 8 is a left side elevational view of the swing conveyor liquid distribution branch line of the dust suppression system.
Figure 10C:
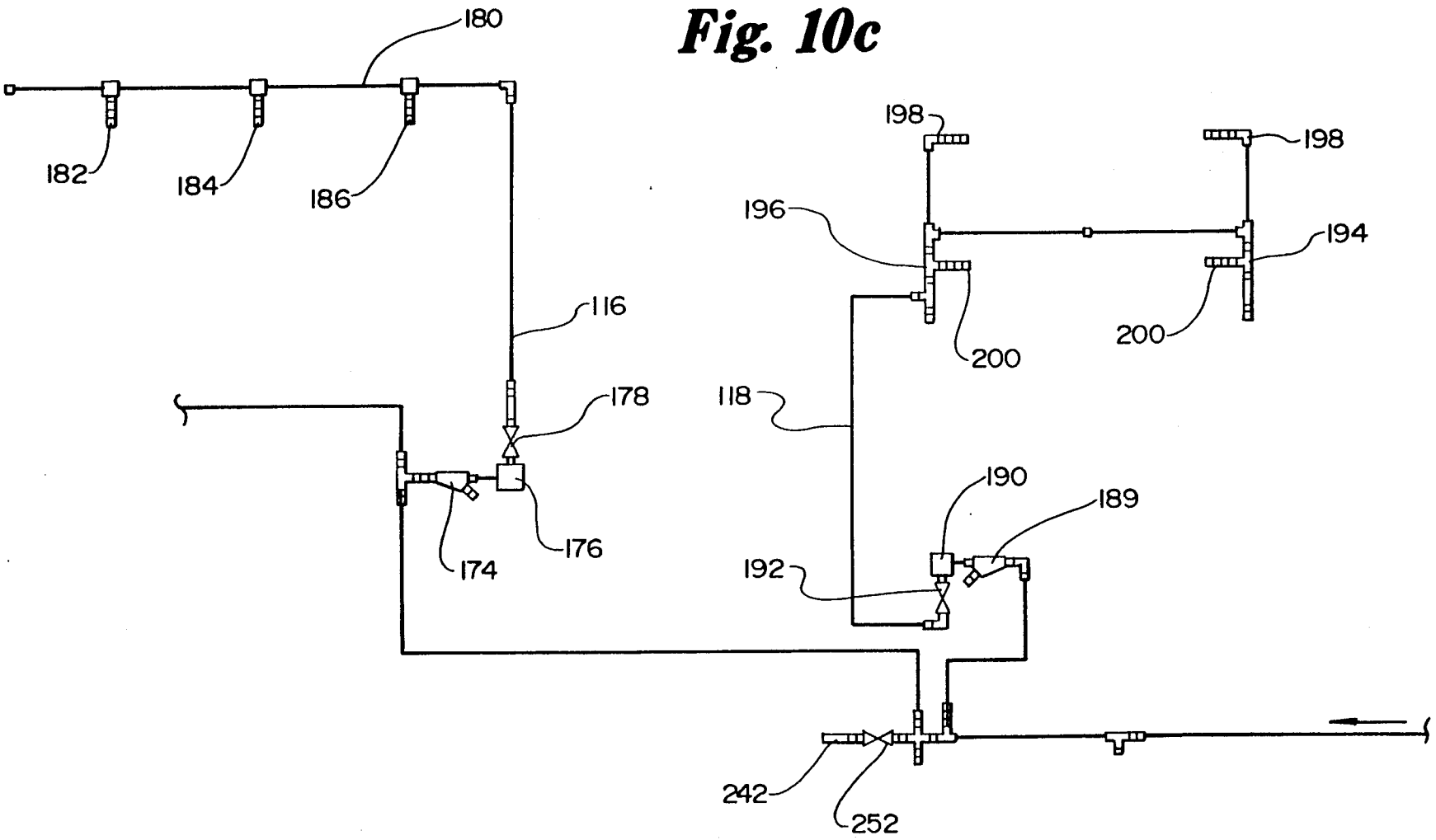

Referring to FIGS. 7 and 10*c* it will be observed that the waste conveyor discharge branch line 116 is similar to the lift conveyor discharge branch line 114. The waste conveyor discharge branch line 116 includes filter 174, actuating solenoid 176, and globe valve 178. The waste conveyor branch line 116 terminates at spray bar 180. The spray bar 180 includes spray nozzles 182, 184, 186. Flashing 188 extends outwardly and downwardly from the top of spray bar 180 so as to protect the fluid spray from the spray bar 180 from wind dissipation.

Figure 1D:
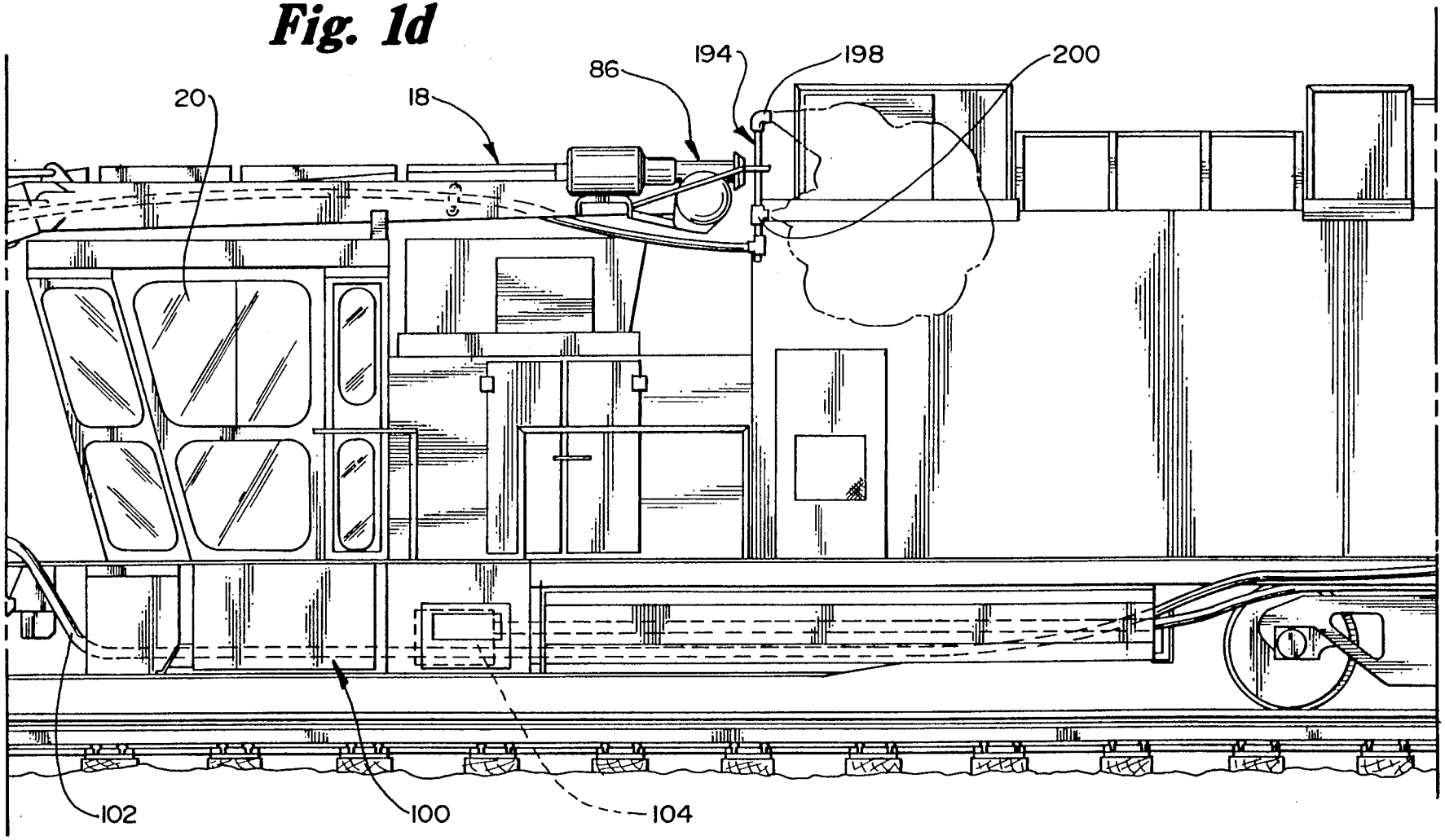
Figure 1E:
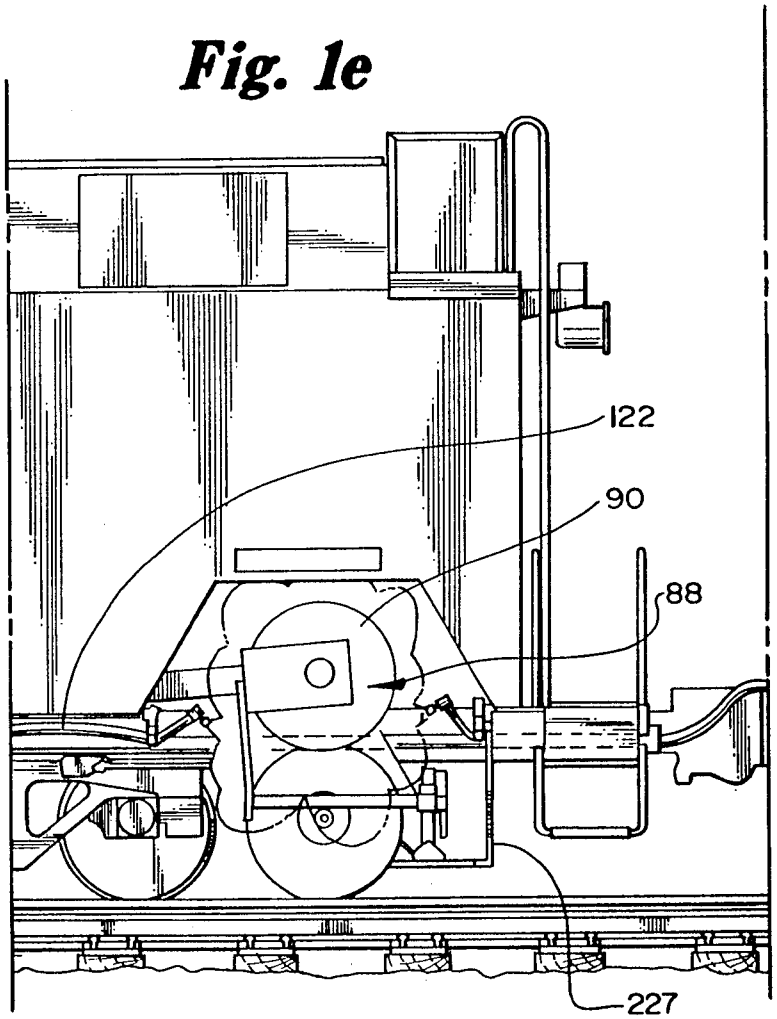
Figure 1F:
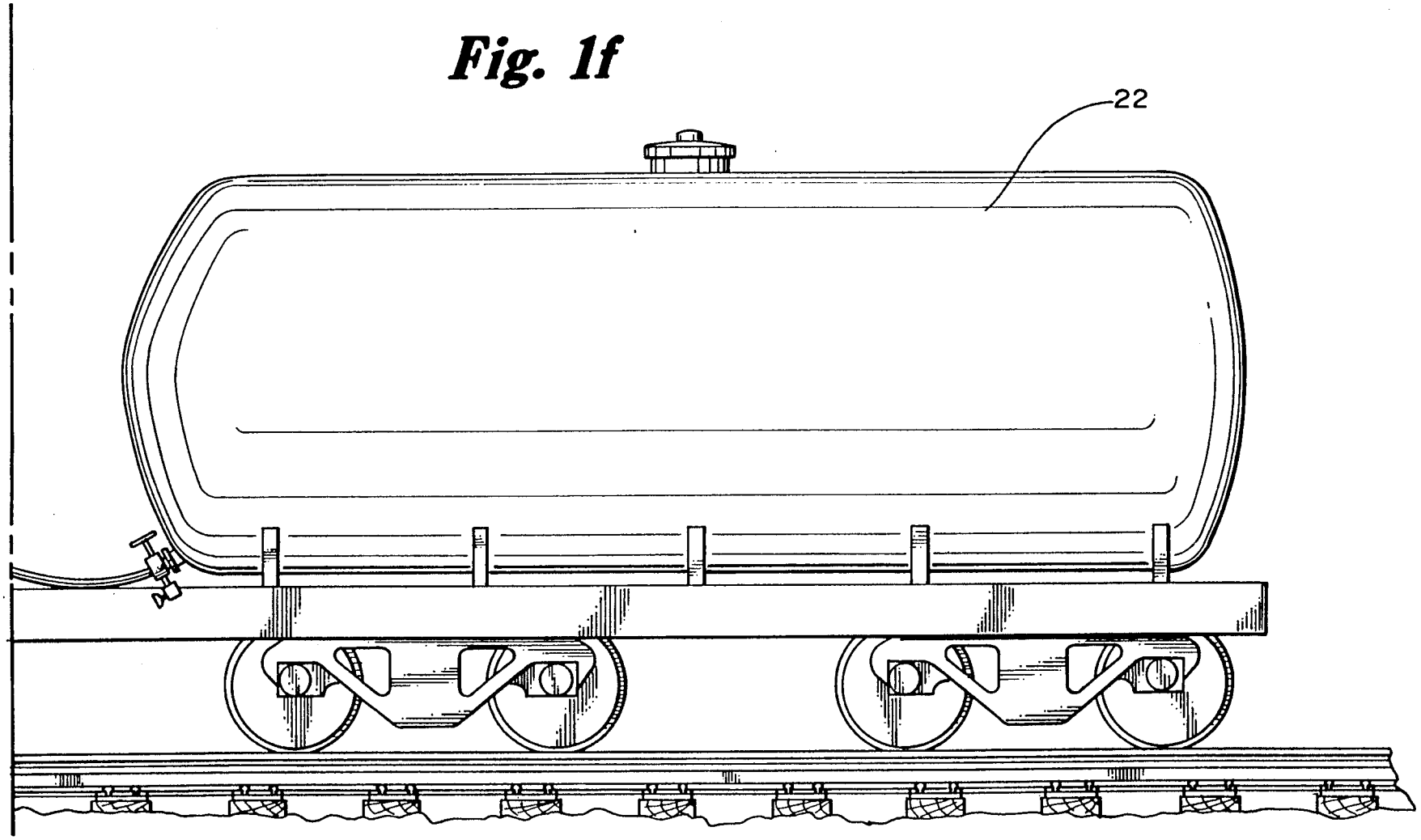
Figure 2D:
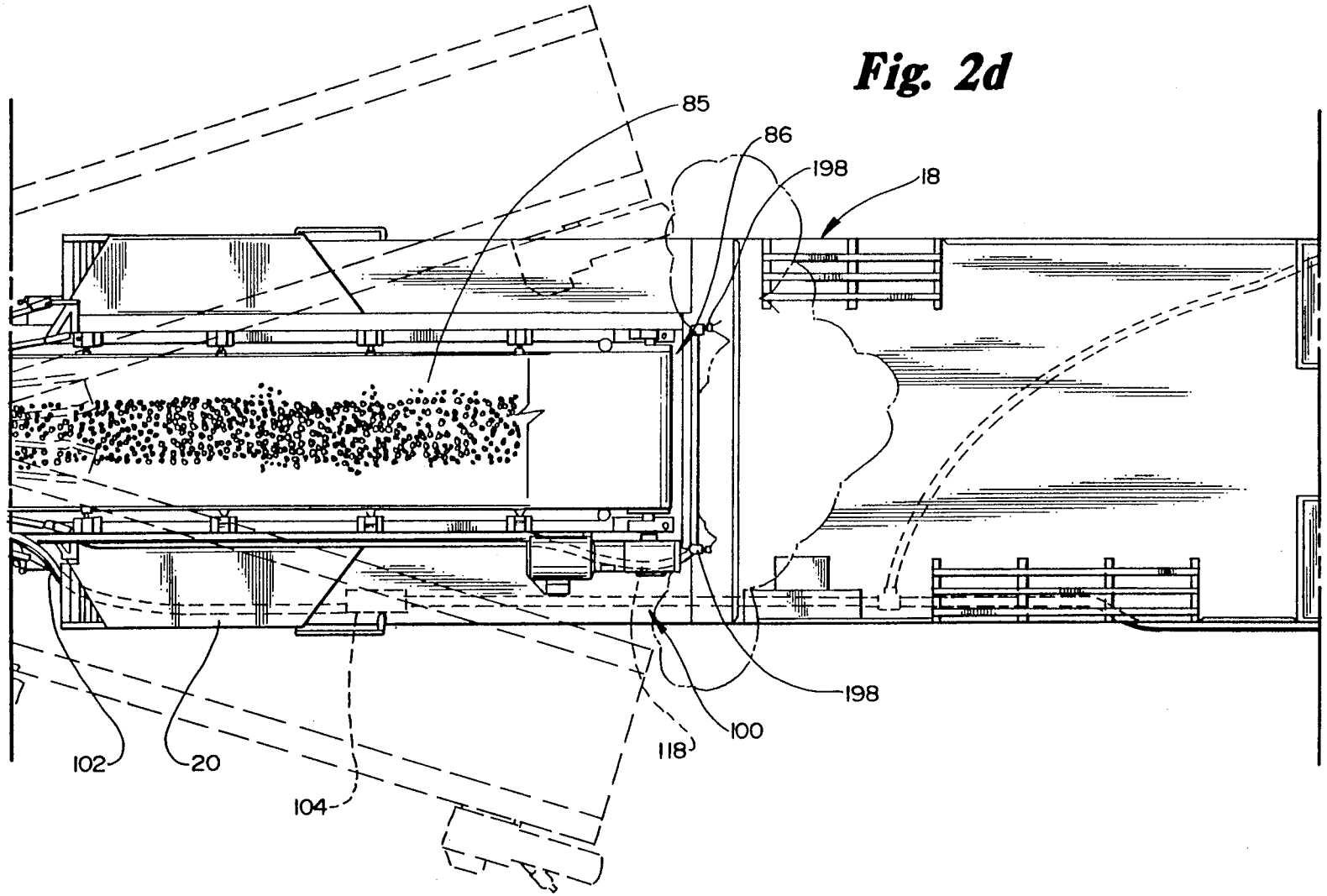
Figure 2E:
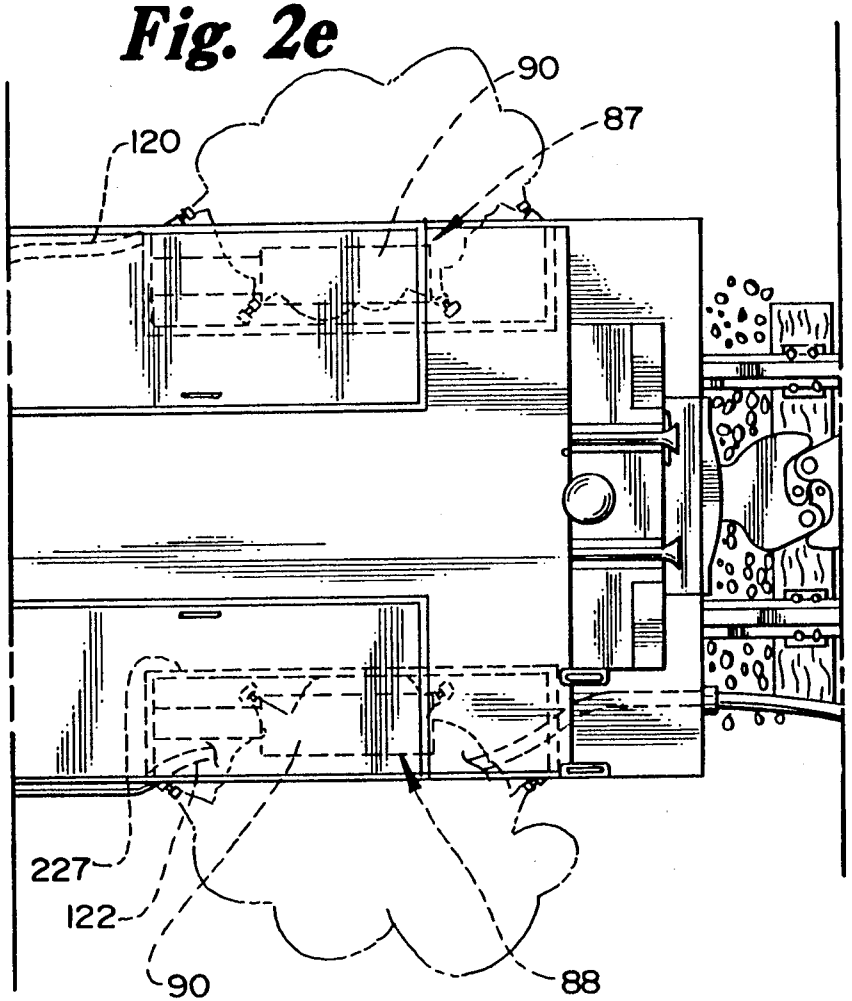
Figure 2F:
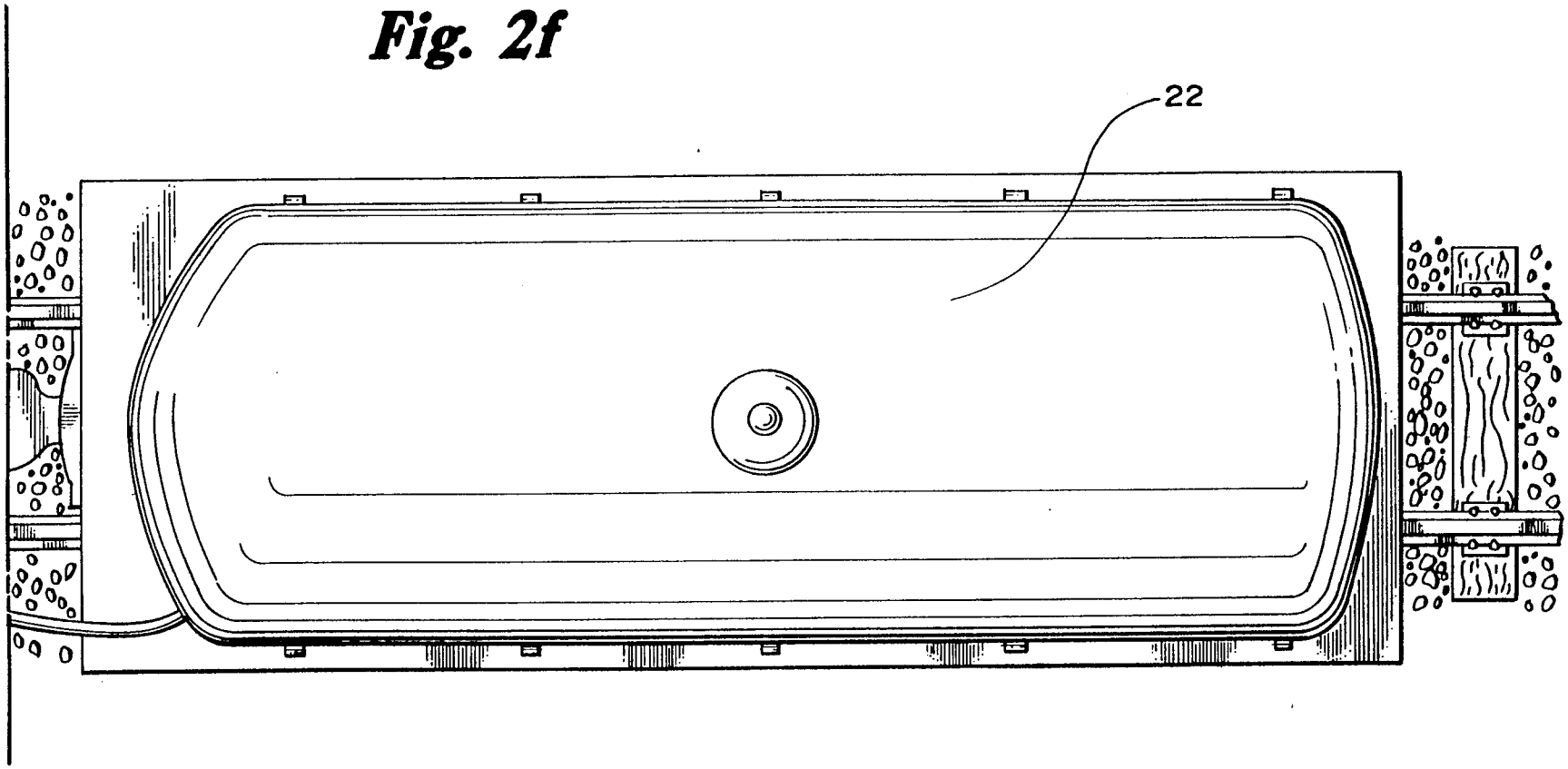
Figure 10D:
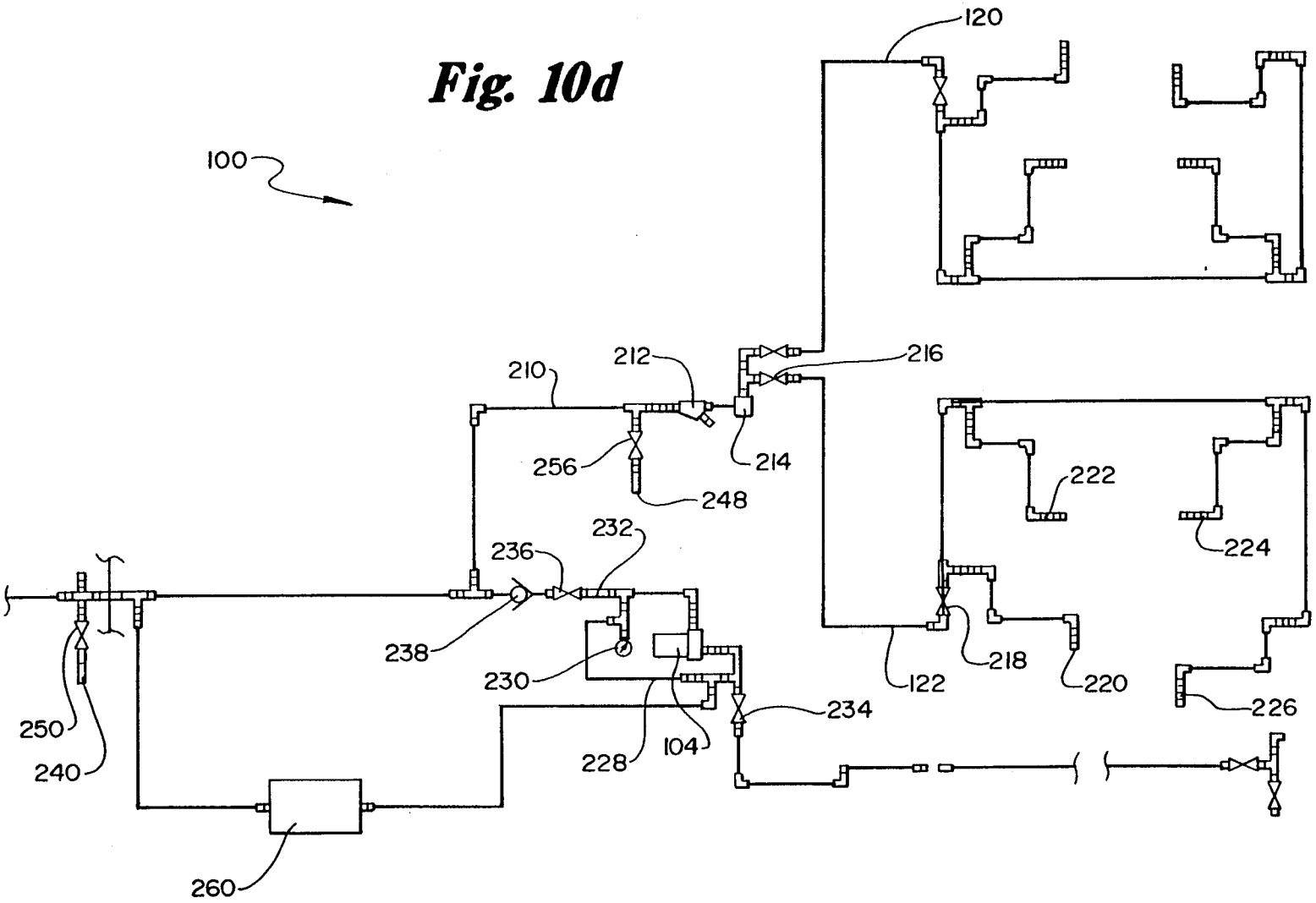

Referring to FIGS. 1*d*, 2*d*, and 10*d*, the swing conveyor discharge branch line 118 includes filter 189, activating solenoid 190, and flow regulating globe valve 192. The swing conveyor discharge branch line 118 terminates at a pair of opposed right and left spray assemblies 194, 196. Each spray assembly 194, 196 includes an upper spray nozzle 198 and a lower spray nozzle 200. The upper spray nozzles 198 are preferably adjusted slightly downwardly, and the lower spray nozzles 200 are preferably adjusted slightly upwardly, and are positioned so as to be above and below the stream of waste and debris discharge from the swing conveyor 46.

The right and left broom assembly branch lines 120, 122 will be described with reference to FIGS. 1*e*, 2*e*, 9, and 10*d*. Referring to FIG. 10*d*, the right and left broom assembly branch lines 120, 122 are connected to main line 102 by intermediate line 210. The intermediate line includes filter 212, and actuating solenoid 214. The right and left broom assembly branch lines 120, 122 are identical, and only the left broom assembly branch line 122 will be described. The broom assembly branch line 122 includes flow regulating globe valve 216 and isolation ball valve 218. The branch line 122 terminates at four spray nozzles 220, 222, 224, 226. As is best seen in FIG. 9, the spray nozzles 220, 222, 224, 226 are oriented to the front and rear, right and left, of the broom assembly 88. Flashing 227 is provided to isolate the spray nozzles 220, 222, 224, 226 from wind dissapation.

Referring to FIG. 10*d*, pressure pump 104 includes a return line 228 that provides for cooling circulation. Pressure gauge 230 and flow meter 232 are provided in conjunction with the pressure pump 104 for on-site monitoring of the pump operation. The pump is isolated from a tank car 22 by valve 234 and is isolated from the pressurized side of main line 102 by ball valve 236 and check valve 238. A plurality of wash connection outlets 240, 242, 246, 248 are provided that allow for connection of a hose (not shown) to the mainline 102 by respective globe valves 250, 252, 254, 256. An optional high pressure pump 260 can be provided in parallel with the pressure pump 104 to provide a high enough pressure to main line 102 to allow for use of the wash connection outlets and to wash down the shoulder ballast cleaning machine 10.

In operation, tank car 22 is filled with water, or some other suitable surfactant. When shoulder ballast cleaning operations are about to begin, the operator in the rear operator cab 20 pressurizes the main line 102 by activating the pressure pump 104. The operator can remotely connect each of the branch lines to the pressurized main line 102 from a control panel having individual activation switches for each of the solenoids in the branch lines. The globe valves in each of the branch lines can be adjusted so as to control the fluid flow within the branch line. It will be appreciated, therefore, that the use of fluid from the tank car 22 can be controlled by activating only the branch lines that are necessary, and by controlling the fluid flow within each activated branch line.

Each of the described spray nozzles are detachably and adjustably received by their respective spray bars, assemblies, or mounts. The spray pattern of each group of spray nozzles can therefore be adjusted by changing the type of spray nozzle, and by adjusting the direction of the spray nozzle. More particularly, the digger wheel spray nozzles 130, 132 are preferably full cone type spray nozzles, and the spray nozzles carried by the cross conveyor spray bars 138, 140 are preferably wide angle, full cone spray nozzles. The hopper spray nozzles 152, 154, lift conveyor spray nozzles 164, 166, 168, waste discharge spray nozzles 182, 184, 186, and broom spray nozzles 222, 224, 226 preferably all provide a hollow cone spray pattern. The swing conveyor spray nozzles 198, 200 preferably provide a narrow angle, full cone spray pattern.

The spray patterns provided by the dust suppression system 100 are preferably made up of fine mist spray. Accordingly, the spray patterns are susceptible to wind dissipation. As described hereinabove, the digger wheel spray nozzles are isolated from wind dissipation by digger wheel shrouds 64, 66, and the spray patterns provided by the lift conveyor spray nozzles, waste conveyor spray nozzles, and broom assembly spray nozzles are protected from wind dissipation by the use of flashing.

We claim:

1. A self-contained dust suppression system for a self-propelled railway shoulder ballast cleaning machine having a digger wheel having a plurality of digger buckets for scooping up fouled ballast having dust generating debris embedded therein from a bucket insertion point along a railway shoulder and depositing said fouled ballast within said machine, a first conveyor having a first end operably positioned for receiving said fouled ballast from said digger wheel and a second end, ballast cleaning means operably positioned to receive said fouled ballast from said first conveyor second end for separating said debris from said fouled ballast to provide clean ballast and separated debris, and a second conveyor having a first end operably positioned for receiving said separated debris and a second end for discharging said separated debris from said machine, said dust suppression system including:

a storage tank for storing a working quantity of dust suppressing liquid sufficient for prolonged operations of said ballast cleaning machine independent of a source of resupply of said liquid, said tank being operably coupled to said ballast cleaning machine for transport therewith;

a main liquid distribution line extending generally along the length of said machine;

pressure means operably coupling said main line to said reservoir for pressurizing said main line with liquid;

a plurality of branch liquid distribution lines in fluid communication with said main line having a plurality of nozzle means operably positioned with respect to said dust generating debris for maximizing dust suppression with minimum use of liquid;

control means operably coupled to said branch liquid lines for selectively controlling the rate of flow of said liquid to maximize dust suppression with minimum usage of said liquid through said nozzle means; and liquid spray containment means operably disposed with respect to said nozzle means for shielding said liquid spray generated by said nozzle means from dissipation by wind and for directing said liquid spray to maximize dust suppression with usage of a minimum amount of said liquid, where by said liquid in said tank is conserved.

2. The invention as claimed in claim 1, said liquid spray containment means including digger wheel shroud means for shielding said digger wheel, said digger wheel being positioned within an internal chamber presented by said shroud means, said plurality of branch liquid distribution lines including a first branch line and said nozzle means including a first nozzle means oriented so as to generate a first liquid spray pattern within said internal chamber and said control means including first flow control means operably coupled to said first branch line for selectively controlling the rate of flow of said liquid through said first nozzle means.

3. The invention as claimed in claim 2, said shroud means including a field side sidewall and a gauge side sidewall, said first nozzle means including first and second nozzles operably positioned on said field side sidewall and said gauge side sidewall respectively, said first and second nozzles being generally aligned in a common vertical plane, and mutually vertically displaced.

4. The invention as claimed in claim 2, including a second branch liquid distribution line in fluid communication with said main line and said nozzle means including second nozzle means for generating a second liquid spray pattern proximal said first conveyor first end, said control means including second flow control means operably coupled to said second branch line for selectively controlling the rate of flow of said liquid through said second nozzle means.

5. The invention as claimed in claim 4, including a third branch liquid distribution line in fluid communication with said main line including third nozzle means for generating a third liquid spray pattern proximal said first conveyor second end, said control means including third flow control means operably coupled to said third branch line for selectively controlling the rate of flow of said liquid through said third nozzle means.

6. The invention as claimed in claim 5, said liquid spray containment means further including first flashing means for operably covering said first conveyor second end, said third nozzle means being oriented so as to generate said third liquid spray pattern internally of said first flashing means.

7. The invention as claimed in claim 6, including a fourth branch liquid distribution line in fluid communication with said main line including fourth nozzle means for generating a fourth liquid spray pattern proximal said second conveyor first end, said control means including fourth flow control means operably coupled to said fourth branch line for selectively controlling the rate of flow of said liquid through said fourth nozzle means.

8. The invention as claimed in claim 7, said ballast cleaning means including a debris discharge end and said liquid spray containment means further including second flashing means for operably covering said debris discharge end, said fourth nozzle means being oriented so as to generate said fourth liquid spray pattern internally of said second flashing means.

9. The invention as claimed in claim 8, including a fifth nozzle means for generating a fifth liquid spray pattern proximal said second conveyor second end, said control means including fifth flow control means operably coupled to said fifth branch line for selectively controlling the rate of flow of said liquid through said fifth nozzle means.

10. The invention as claimed in claim 9, said fifth nozzle means including right and left nozzle assemblies oriented at the right and left of said second conveyor second end respectively, and each of said right and left nozzle assemblies including an upper and lower nozzle element oriented above and below said second conveyor second end respectively such that said fifth liquid spray pattern surrounds said second conveyor second end.

* * * * *

UNITED STATES PATENT AND TRADEMARK OFFICE

CERTIFICATE OF CORRECTION

PATENT NO. : 5,172,638

DATED : December 22, 1992

INVENTOR(S) : Dennis R. Mathison et al.

It is certified that error appears in the above-identified patent and that said Letters Patent is hereby corrected as shown below:

Column 1, line 6, delete "67/507,717" and substitute therefor -- 07/507,717 --.

Signed and Sealed this

Thirtieth Day of November, 1993

Bruce Lehman

*Attest:*

BRUCE LEHMAN

*Attesting Officer*

*Commissioner of Patents and Trademarks*